United States Patent [19]

Edstrom

[11] 3,964,595

[45] June 22, 1976

[54] RIBBON GUIDE FOR A SERIAL PRINTER

[75] Inventor: Andrew H. Edstrom, Oahu, Hawaii

[73] Assignee: Xerox Corporation, Stamford, Conn.

[22] Filed: Jan. 23, 1975

[21] Appl. No.: 543,560

[52] U.S. Cl. ..... 197/170

[51] Int. Cl.[2] ..... B41J 31/12; B41J 35/04

[58] Field of Search ..... 197/151, 168, 170

[56] References Cited

UNITED STATES PATENTS

| | | | |
|---|---|---|---|
| 408,289 | 8/1889 | Brott | 197/170 |
| 1,005,158 | 10/1911 | Clevenger | 197/151 |
| 1,015,594 | 1/1912 | Spurgin | 197/151 |
| 3,017,981 | 1/1962 | Keith | 197/170 |
| 3,532,204 | 10/1970 | Sasaki | 197/151 |
| 3,831,731 | 8/1974 | Mack et al. | 197/151 |
| 3,871,507 | 3/1975 | Perry et al. | 197/151 |
| 3,877,561 | 4/1975 | Guerrini et al. | 197/151 |

*Primary Examiner*—Edgar S. Burr
*Assistant Examiner*—William Pieprz

[57] ABSTRACT

A ribbon guide for a serial printer comprising a generally dish-shaped member which closely covers a portion of the outer periphery of the print wheel near the area of the print position to support the ribbon close to said area.

9 Claims, 10 Drawing Figures

RIBBON GUIDE FOR A SERIAL PRINTER

BACKGROUND OF THE INVENTION

This invention relates in general to ink ribbon-guide apparatus and more particularly to ink ribbon-guide apparatus employed in serial printers which employ ribbon cartridges.

The use of ribbon cartridges for typewriters and serial printers to assist in the installation of ribbons into such machines and to minimize the soiling of fingers during such process is well known in the art. In addition to minimizing typist contact with the ribbons, ribbon cartridges minimize and in certain cases eliminate the tedious threading of the ribbon through various ribbon guide and/or lift mechanisms. Also, the use of ribbon cartridges has been found helpful in increasing the useful life of the ribbons and the quality of printing by shielding the ribbon from exposure to the surrounding environment. But even with the use of ribbon cartridges, it is still often necessary to thread the ribbon through various ribbon guide and/or lift mechanisms. The type and layout of the ribbon guide and/or lift mechanism for a serial printer is determined by the particular printing environment. The ribbon cartridge provides, for use at the printing area or position, an unsupported length of ribbon from an axit port to an entrance port in the ribbon cartridge.

In regard to the guiding of ink ribbons across the printing area, it is well known to use a combination ribbon guide and ribbon lift in conjunction with a type-bar printer using separate ribbon supply and ribbon take-up spools as disclosed in U.S. Pat. Nos. 2,815,110 and 3,409,113. In this type of application, the unsupported span of ribbon between the outer sections of the ribbon guide is relatively short because of the narrow width of the type-bar printing element.

It is also known to use a combination ribbon guide and ribbon lift in conjunction with a ball-type printhead printer using a ribbon cartridge on a movable carriage as shown in U.S. Pat. Nos. 3,346,090 and 3,349,887. Although the unsupported span of ribbon is greater because of the ball-type printhead, the printhead normally rests a relatively large distance from the ribbon and approaches and contacts the ribbon only during the actual printing sequence.

It is also known to use a suction or vacuum in conjunction with the ribbon guide surface to hold the ribbon in close contact with the guide surface as disclosed in U.S. Pat. No. 2,973,082.

In U.S. Pat. No. 3,799,315, a ribbon guide is disclosed which is pivotally connected to and laterally extends from the ribbon cartridge to guide the ribbon from the ribbon cartridge to the print station and back to the ribbon cartridge.

The Diablo Corporation, a subsidiary of the present assignee, is marketing a serial printer under the tradename of Diablo Hytype I which employs a print wheel or disc-shaped type carrier. The Diablo Hytype I printer is enjoying commercial success as a serial printer in such applications as communication terminals, computer output devices, etc. The present assignee has recently marketed an electronic typing system for use in the office environment and used the Diablo Hytype I as the basis for the printer subsystem. The Diablo Hytype I provides superior performance for the particular market and environment for which it was designed. In using the Diablo Hytype I as the printer subsystem of the electronic typing system for use in the office environment, it was desirable to improve the print quality of the printed record. The Diablo Hytype I uses a ribbon cartridge containing a fabric ribbon. The quality of printing obtained from the fabric ribbon could be improved and a change was made to the matrix-type plastic ribbon from which a higher quality of printed material may be obtained. It was also necessary to greatly increase the hammer energy so the hammer would impart each character slug against the ribbon with a greater force. The necessary change in the hammer solenoid required to obtain the higher hammer energy necessitated a slight change in the mounting bracket for the ribbon guide of the Hytype I serial printer. The ribbon guide of the serial printer in the office environment must guide and control the ribbon precisely in order to maintain the high print quality demanded.

With reference to FIG. 1, the traditional vertical guide bars of the prior art Hytype I serial printers are approximately 2.25 inches apart; therefore, the ribbon is unsupported across the length of this span. In this environment, when the matrix-type plastic ribbon was impacted between the character slug of the print wheel and the paper, the plastic ribbon tended to curl or become cup-shaped around a longitudinal centerline of the ribbon. The upper and lower edges of the plastic ribbon curled toward the print wheel. The spacings between the paper, ribbon and print wheel are extremely close and on occasions the curled edge or edges of the plastic ribbon would make contact with the print wheel while the print wheel was rotating to the next print position. When this type of contact occurred, two basic types of malfunctions occurred: (1) the plastic ribbon was flipped to the backside of the print wheel resulting in a complete loss of printing or (2) the plastic ribbon was prevented from completely lifting to its print position from its lower rest position resulting in the loss of that particular character or the cropping of the upper portions of the characters.

With these prior art problems in mind, it is a primary object of the present invention to develop a ribbon guide suitable for a wide range of impact printing environments.

Another object of this invention is the construction of an economical method and apparatus for guiding ink ribbons for serial printers.

Yet, another object of this invention is to improve the guiding of ink ribbon fed between spools in a ribbon cartridge of the type used in serial printers.

A further object of this invention is the construction of a ribbon guide having improved mechanical and functional features over prior ribbon guides.

Other objects and advantages will be evident from the specification and claims and the accompanying drawing illustrative of the invention.

BRIEF DESCRIPTION

These and other objects of the present invention are accomplished by a generally dish-shaped member which closely covers a portion of the outer periphery of the print wheel in the vicinity of the print position or station. The generally dish-shaped member has a generally right angle extension along its outer periphery which extends toward and over the character slugs positioned at the outer periphery of the beams of the print wheel. By essentially covering the print wheel near the print position, the ribbon guide provides support to the ribbon up to a point or location very close to the print position and therefore minimizes any effect of any curl introduced into the ribbon by the printing operation. In addition, the ribbon guide prevents the print wheel from contacting the ribbon except during the printing operation. The one-piece ribbon guide is formed from preferred materials of metal or plastic. In one embodiment of the ribbon guide, the generally dish-shaped member includes two ear-like vertical protrusions (one on each side of the print position or station) to guide the ribbon to its proper position when a ribbon cartridge is installed on the movable carriage.

DESCRIPTION OF THE DRAWING

Other advantages and features of the present invention may become more apparent from reading the following detailed description in connection with the drawing forming a part thereof, in which.

DETAILED DESCRIPTION

Figure 1:
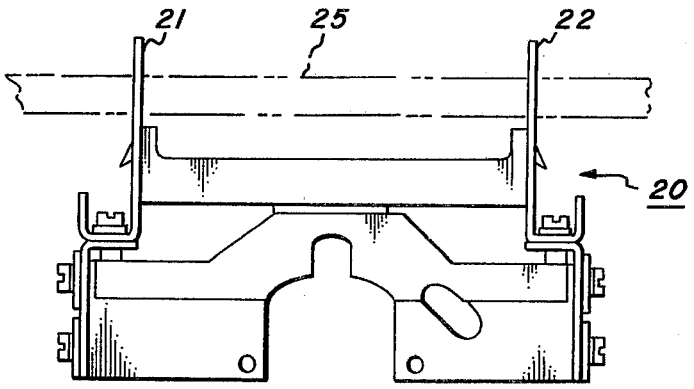
FIG. 1 PRIOR ART
FIG. 1 is a plan view of the ribbon guide of the prior art.

Referring now to the drawing and more particularly to FIG. 1, there is shown the ribbon guide 20 of the prior art with the two widely-spaced upright guides 21 and 22 supporting the ribbon 25. The two widely-spaced upright guides 21 and 22 are approximately 2.25 inches apart. The ribbon guide 20 is comprised of approximately 22 separate parts which tends to add to the complexity of manufacture and assembly as well as added cost.

Figure 2:
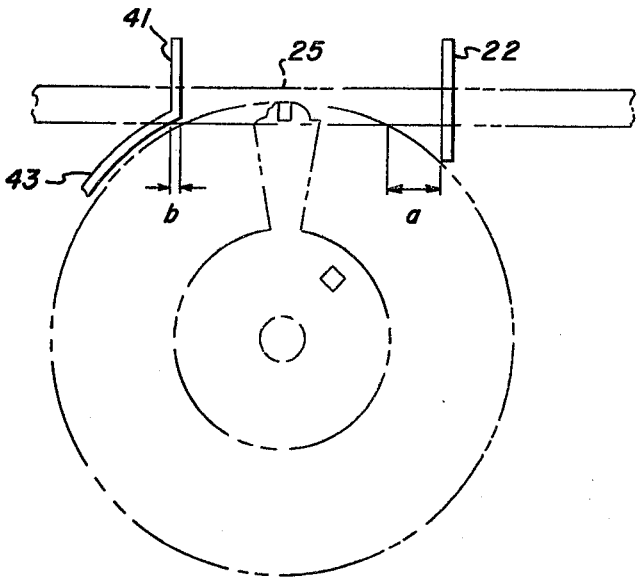
FIG. 2 is a sketch comparing the lengths of unsupported ribbon with the prior art and the invention herein.

As shown in FIG. 2, the unsupported length (*a*) of the ribbon 25 to the periphery of the print wheel, as associated with the exemplary upright guide 22 of the prior art, is much greater than the unsupported length (*b*) of the ribbon 25, as associated with the upright guide 41 and the generally right-angle extension 43 of the invention herein. The unsuppoted length of the ribbon from the particular guide to the character slugs positioned at the outer periphery of the beams of the print wheel is the critical dimension affecting the contact of the ribbon by the character slugs as the print wheel rotates from one print position to a succeeding one. It is the contact at this location which causes the problems of (1) ribbon flip to the backside of the print wheel or (2) loss of character printing or cropping of the upper portions of the printed character because the ribbon was prevented from completely lifting to the print position. It is not possible to simply move the upright guide

22 of the prior art closer to the print wheel and thereby reduce the amount of unsupported length (*a*) of the ribbon 25 because the lower extremity of the upright guide 22 would contact the outer periphery of the print wheel. The invention herein reduces the unsupported length of the ribbon between the guide and the outer periphery of the print wheel without causing contact interference with the rotating print wheel.

Figure 3A:
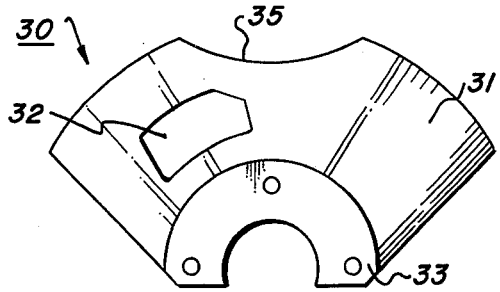
FIG. 3A is a plan view of one embodiment according to the invention herein.
Figure 3B:
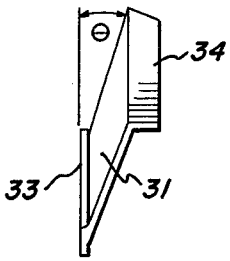
FIG. 3B is a side view of the embodiment of FIG. 3A according to the invention herein.
Figure 3C:
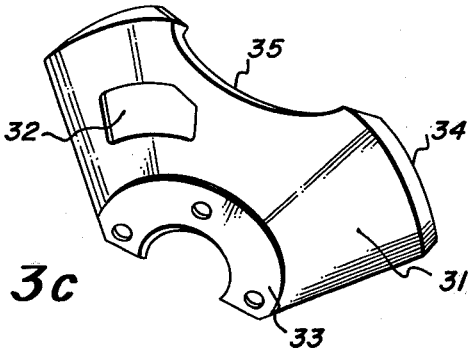
FIG. 3C is a perspective view of the embodiment of FIG. 3A according to the invention herein.

As shown in FIGS. 3A, 3B and 3C, one embodiment of the invention herein comprises a generally dish-shaped section 31 covering an angle of approximately 90°. Opening 32 allows the carriage locking means (not shown) to extend therethrough for easy access and operation to lock and/or unlock the pivotable portion of the carriage (not shown). Mounting section 33 is removably secured in a vertical position to the carriage (not shown) with the dish-shaped section 31 being at an angle $\theta$ from the mounting section of approximately 18° and angled toward the print wheel. The inner and outer radius of the mounting section 33 is approximately 0.3 inches and 0.7 inches, respectively. The outer radius of the generally dish-shaped section 31 is approximately 1.6 inches. The right angle extension 34 of approximately 0.2 inches in width extends over the outer periphery of the print wheel and covers or shields the print wheel. Because of its shape, ribbon guide 30 closely conforms to and extends over the outer periphery of the print wheel and guides the ribbon across the area of the print position and station while only allowing contact between the ribbon and the print wheel during the printing operation. The center portion 35 of the outer periphery of the dish-shaped section 31 is reduced in radius to form a cut-out. The print hammer is aligned with the center of the cut-out and passes thereover to contact the character slug of the print wheel. The right angle extension 34 does not extend in the area of the cut-out. The ribbon guide is formed of one piece with preferred materials being metal or plastic.

Figure 4A:
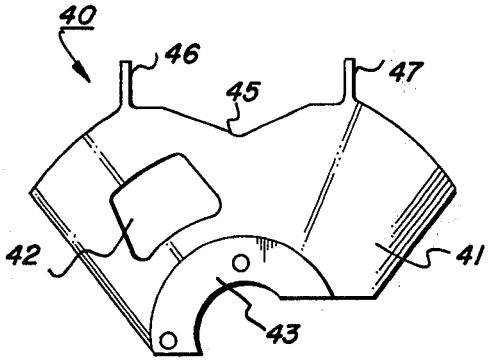
FIG. 4A is a plan view of another embodiment according to the invention herein.
Figure 4B:
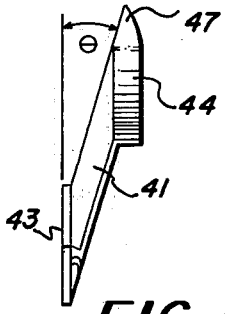
FIG. 4B is a side view of the embodiment of FIG. 4A according to the invention herein.
Figure 4C:
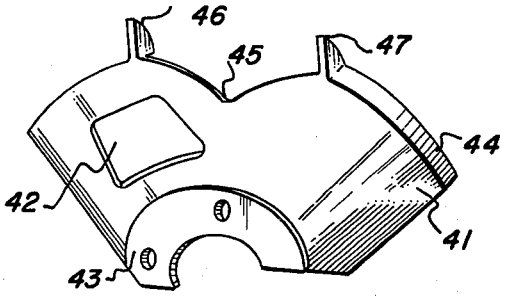
FIG. 4C is a perspective view of the embodiment of FIG. 4A according to the invention herein.

A further embodiment of the invention herein is shown in FIGS. 4A, 4B and 4C and comprises a generally dish-shaped section 41 covering an angle of approximately 90°. Two vertical ear-shaped protrusions 46 and 47, which are approximately 1.45 inches apart, extend from the right angle extension 44 and assist in the insertion of a ribbon cartridge by guiding the unsupported span of ribbon down into position between the print wheel and the platen. The generally dish-shaped section 41 is at an angle $\theta$ of approximately 18° from the vertical mounting section 43. This embodiment has only two mounting holes in mounting section 43 while the embodiment of FIGS. 3A, 3B and 3C had three mounting holes. Opening 42 allows access to the carriage locking means (not shown). The dish-shaped section 41 has a depression 45 to form a cut-out whereby the print hammer is aligned and passes thereover to contact the character slug of the print wheel. The right angle extension 44 does not extend in the area of the cut-out.

Figure 5:
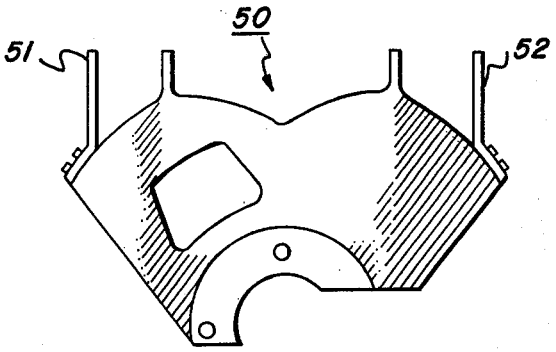
FIG. 5 is a plan view of another embodiment according to the invention herein.

Another embodiment for the ribbon guide is depicted in FIG. 5. It is seen from FIG. 5 that additional vertical guides 51 and 52 have been installed outboard of the two vertical ear-shaped protrusions 46 and 47 of FIGS. 4A, 4B and 4C. The additional vertical guides 51 and 52 provide more even path lengths during the travel of the ribbon from its exit from the ribbon cartridge, its movement across the ribbon guide and its entrance back into the ribbon cartridge. This additional support and equaling of ribbon path lengths assist in more consistent operation of the ribbon.

All the previous embodiments of the ribbon guide could be extended to cover an angle of 360° and thereby provide additional protection to the print wheel.

Figure 6:
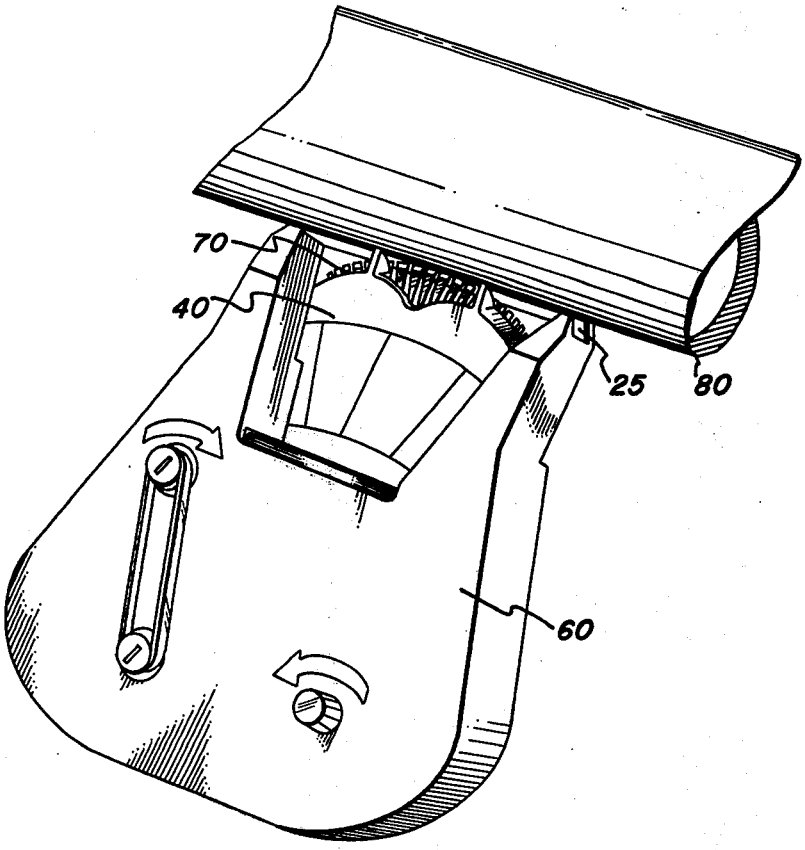
FIG. 6 is a perspective view of a serial printer employing the invention.

As shown in FIG. 6, the ribbon cartridge 60, print wheel 70, ribbon guide 40 and print hammer (not shown) are all mounted on a movable carriage (not shown) for traversing the print line. Prior to printing, the portion of the ribbon cartridge 60 near the platen 80 is pivoted upward to position the ribbon 25 at the print station between the character slugs of the print wheel 70 and the platen 80. After printing the ribbon cartridge 60 is pivoted downward to its non-print position so the operator can view the printed character. The ribbon is advanced after each character is printed. The ribbon guide 40 supports and guides the ribbon 25 when the ribbon cartridge 60 is pivoted up and down and also when the ribbon is advanced.

In summary, the problem of (1) ribbon flip and (2) cropping of printed characters is solved by the invention herein by providing support to the ribbon at a point or location very close to the periphery of the print wheel which allows contact between the ribbon and the print wheel only during the printing operation. An additional advantage of the present invention over prior art ribbon guides is the reduction of the complexity and cost of manufacture and assembly.

It is, therefore, evident that there has been provided in accordance with this invention a ribbon guide for ink ribbons in a serial printer that fully satisfies the objects, aims and advantages set forth above. While the principles of the invention have been made clear in the illustrative embodiments, it is apparent that alternatives, modifications and variations will be evident to those skilled in the art. Accordingly, it is intended to embrace all alternatives, modifications and variations as fall within the spirit and broad scope of the appended claims.

What is claimed is:

1. In a serial printer having a platen, a laterally movable carrier for traversing a printing line, a print wheel supported on said carrier and including a plurality of spokes extending radially outwardly and terminating in a character slug for impacting with said platen at a print position to print characters, ribbon supply means and a ribbon feed means for feeding an ink ribbon past said print wheel including ribbon exit and entrance areas having ribbon guides thereat and said print position; an improved ribbon guide member comprising:

a first concave portion, a second concave portion laterally spaced from said first portion by a convex portion;

said first and concave second portions being positioned on opposite sides of the print position between the ribbon supply guides in a juxtaposed relation with the character slugs, said first and second concave portions defining a concave surface which is transverse to the plane formed by the print wheel spokes and extends over a portion of the print wheel periphery to assist in guiding the ribbon during printing, a mounting portion, and a connecting portion extending from the mounting portion to the first and second portions in an outwardly sloping direction toward the outer periphery of the character slugs of the print wheel said concave and convex portions being concave and convex as viewed from said mounting portion.

2. Apparatus according to claim 1 wherein said first and second concave portions, said mounting portion, and said connecting portion cover an angle less than 360°.

3. Apparatus according to claim 1 wherein said connecting portion covers an angle of 360°.

4. Apparatus according to claim 1 wherein said first and second concave portions include an ear-like vertical projection at the end of each concave portion located nearest the print position.

5. Apparatus according to claim 4 wherein said first and second concave portions include an ear-like vertical projection at the end of each concave portion located furthest from the print position.

6. Apparatus according to claim 1 wherein said connecting portion further defines an aperture therein.

7. Apparatus according to claim 1 wherein said first and second concave portions, said mounting portion and said connecting portion are formed as one piece.

8. Apparatus according to claim 1 wherein said first and second concave portions, said mounting portion and said connecting portion are formed of metal.

9. Apparatus according to claim 1 wherein said first and second concave portion, said mounting portion and said connecting portion are formed of plastic.

* * * * *